US011252995B2

(12) United States Patent
Zappoli

(10) Patent No.: US 11,252,995 B2
(45) Date of Patent: Feb. 22, 2022

(54) APPARATUS AND METHOD FOR THE PRODUCTION OF SHEET LIKE TOBACCO MATERIAL

(71) Applicant: PHILIP MORRIS PRODUCTS S.A., Neuchatel (CH)

(72) Inventor: Stefano Zappoli, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 151 days.

(21) Appl. No.: 16/605,443

(22) PCT Filed: Apr. 13, 2018

(86) PCT No.: PCT/EP2018/059501
§ 371 (c)(1),
(2) Date: Oct. 15, 2019

(87) PCT Pub. No.: WO2018/192844
PCT Pub. Date: Oct. 25, 2018

(65) Prior Publication Data

US 2020/0337362 A1 Oct. 29, 2020

(30) Foreign Application Priority Data

Apr. 18, 2017 (EP) ..... 17166921

(51) Int. Cl.
*A24D 3/02* (2006.01)
*A24C 5/01* (2020.01)
(Continued)

(52) U.S. Cl.
CPC ..... *A24D 3/0204* (2013.01); *A24B 3/14* (2013.01); *A24C 5/01* (2020.01); *A24C 5/18* (2013.01); *A24C 5/28* (2013.01)

(58) Field of Classification Search
CPC ..... A24C 5/01; A24C 5/18; A24B 3/14
See application file for complete search history.

(56) References Cited

U.S. PATENT DOCUMENTS 3,188,924 A 6/1965 Frederick
3,466,358 A * 9/1969 Muller ..... B31F 1/22 264/287

FOREIGN PATENT DOCUMENTS

GB 1 124 434 8/1968
GB 1 276 933 6/1972
WO WO 2015/028644 3/2015

OTHER PUBLICATIONS

PCT Search Report and Written Opinion for PCT/EP2018/059501.

* cited by examiner

*Primary Examiner* — Eric Yaary
*Assistant Examiner* — Jennifer A Kessie
(74) *Attorney, Agent, or Firm* — Mueting Raasch Group

(57) ABSTRACT

The invention relates to a method or apparatus (10) for crimping a sheet (70) of material The apparatus comprises a transport device to transport the sheet of material along a transport direction (1), and a set of crimping rollers (11, 21). The set comprises a first (11) and a second (21) main crimping roller, defining a first (18) and a second (28) rotational axis and being faced one in front of the other, the first roller including a first plurality of ridges (17) across a portion of its width (16), and the second roller having a second plurality of ridges (27) across a portion of its width; and a pre-crimping roller facing the first roller and having a third plurality of ridges across a portion of its width, the pre-crimping roller having a diameter smaller than a diameter of the first and second main roller.

14 Claims, 3 Drawing Sheets

(51) Int. Cl.

| | |
|---|---|
| ***A24B 3/14*** | (2006.01) |
| ***A24C 5/18*** | (2006.01) |
| ***A24C 5/28*** | (2006.01) |

APPARATUS AND METHOD FOR THE PRODUCTION OF SHEET LIKE TOBACCO MATERIAL

This application is a U.S. National Stage Application of International Application No. PCT/EP2018/059501 filed Apr. 13, 2018, which was published in English on Oct. 25, 2018 as International Publication No. WO 2018/192844 A1. International Application No. PCT/EP2018/059501 claims priority to European Application No. 17166921.1 filed Apr. 17, 2017.

This invention relates to an apparatus and a process for producing sheet-like tobacco material. In particular, the invention relates to an apparatus and a process for producing sheet-like tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP 0565360.

In a typical manufacturing process of aerosol generating articles, at least one component comprises a material, usually in a sheet or foil format, that goes through a crimping process. The crimped material is then compressed into a rod which is cut into parts, usually tubular. These cut rods are components of the aerosol generating articles.

While the crimping process is helpful for compressing and folding the sheet of material into rods that will fit into the aerosol generating articles, the crimping process also influences, inter alia, the amount of air contact, the Resistance To Draw (RTD), and others, and, hence, is directly experienced by the users of the aerosol generating articles.

As a consequence, applying an adequate crimping pressure is an important aspect of the crimping process. While a too low crimping pressure may decrease the positive effects of the crimping, a too high pressure could damage the sheet of material or decrease its tensile strength, which in turn may increase tearing occurrence and can even cause shredding.

The crimping process generally uses two rotating cylindrical rollers between which the sheet of material is pressed. These rollers have matching textured ridge-and-trough patterns on their outside surfaces that crimp the sheet.

The overall production process has to run at high speed. The shorter the crimping time, the more pressure has to be applied to assure a proper crimping of the sheet of material, which increases the risk to damage the sheet during the crimping process.

There is therefore a need for an apparatus and a method for crimping a sheet of material with which an improved consistency in the final product, in particular when high crimping speeds are used, may be achieved.

According to a first aspect, the invention relates to a method of manufacturing a crimped sheet of material for an aerosol-generating article, the method comprising the steps of: feeding a substantially continuous sheet of material to a set of crimping rollers in a transport direction, the set of rollers comprising a first main roller, a second main roller and a pre-crimping roller, the first and second main rollers including a first and a second plurality of ridges, respectively, across at least a portion of their width and the pre-crimping roller including a third plurality of ridges across a portion of its width, a diameter of the pre-crimping roller being smaller than a diameter of the first and second main rollers; pre-crimping the substantially continuous sheet of material to form a pre-crimped sheet by feeding the substantially continuous sheet between the first main roller and the pre-crimping roller such that the first plurality of ridges of the first main roller and the third plurality of ridges of the pre-crimping roller apply a first pattern of crimp corrugations to the substantially continuous sheet; and crimping the pre-crimped sheet of material to form a crimped sheet by feeding the substantially continuous sheet between the first main roller and the second main roller such that the first and second plurality of ridges of the first and second main rollers apply a second pattern of crimp corrugations to the pre-crimped sheet.

According to another aspect, the invention relates to an apparatus for crimping a sheet of material, the apparatus including a transport device to transport the sheet of material along a transport direction; a set of crimping roller, the set comprising: a first and a second main crimping roller, defining a first and a second rotational axis and being faced one in front of the other, the first roller including a first plurality of ridges across a portion of its width, and the second roller having a second plurality of ridges across a portion of its width; and a pre-crimping roller facing the first roller and having a third plurality of ridges across a portion of its width, the pre-crimping roller having a diameter smaller than a diameter of the first and second main roller.

According to the invention, the sheet of material is first pre-crimped and then crimped, that is, the crimping is performed in two different steps. By pre-crimping the sheet of material by means of a pre-crimping roller, before crimping it between the first and second main rollers, a gentle preparation of the sheet of material for the crimping process is obtained and, hence, the crimping damage may be reduced and a better control on the outcome of the crimping process may be possible.

This may be in particular advantageous when the crimped sheet of material is used for the manufacture of an aerosol generating article, because a better control of the crimping process may in turn allow a better control on the characteristics of the aerosol generating article.

As used herein, the term "aerosol-generating article" refers to an article comprising an aerosol-forming substrate that is capable of releasing volatile compounds that can form an aerosol, for example by heating, combustion or a chemical reaction. As used herein, the term 'aerosol-forming substrate' is used to describe a substrate capable of releasing volatile compounds, which can form an aerosol. The aerosols generated from aerosol-forming substrates of aerosol-generating articles according to the invention may be visible or invisible and may include vapours (for example, fine particles of substances, which are in a gaseous state, that are ordinarily liquid or solid at room temperature) as well as gases and liquid droplets of condensed vapours.

An aerosol-generating article may be a heated aerosol-generating article, which is an aerosol-generating article comprising an aerosol-forming substrate that is intended to be heated rather than combusted in order to release volatile compounds that can form an aerosol. A heated aerosol-generating article may comprise an on-board heating means forming part of the aerosol-generating article, or may be configured to interact with an external heater forming part of a separate aerosol-generating device.

An aerosol-generating article may resemble a combustible smoking article, such as a cigarette. An aerosol-generating article may comprise tobacco. An aerosol-generating article may be disposable. An aerosol-generating article may alternatively be partially-reusable and comprise a replenishable or replaceable aerosol-forming substrate.

Preferably, the aerosol-forming substrate is formed from or comprises a homogenised tobacco material having an aerosol former content of greater than 5 percent on a dry weight basis and water. For example the homogenised tobacco material may have an aerosol former content of between 5 percent and 30 percent by weight on a dry weight basis. An aerosol generated from such aerosol-forming substrates may be perceived by a user to have a particularly high temperature and the use of a high surface area, low resistance to draw aerosol-cooling element may reduce the perceived temperature of the aerosol to an acceptable level for the user. The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be received in the aerosol-generating device such that the length of the aerosol-forming substrate is substantially parallel to the airflow direction in the aerosol-generating device. The aerosol-cooling element may be substantially elongate.

The aerosol-generating article may have a total length between about 30 millimeters and about 100 millimeters. The aerosol-generating article may have an external diameter between about 5 millimeters and about 12 millimeters.

The aerosol-generating article may comprise a filter or mouthpiece. The filter may be located at the downstream end of the aerosol-generating article. The filter may be a cellulose acetate filter plug. The filter may have a length of between about 5 millimeters and about 10 millimeters and may be about 7 millimeters in length. The aerosol-generating article may comprise a spacer element located downstream of the aerosol-forming substrate.

Preferably, the crimped sheet is a sheet of homogenized tobacco material. The crimped sheet may be a sheet of plant-originated material. Preferably, the plan-originated material may contain alkaloids. Even more preferably, the plant-originated material includes tobacco.

As used herein, the term "homogenized tobacco material" denotes material formed by agglomerating particulate tobacco.

A homogenized tobacco material may be in the form of a sheet. The homogenized tobacco material may have an aerosol-former content of greater than about 5 percent on a dry weight basis. The homogenized tobacco material may have an aerosol former content of between about 5 percent and about 30 percent by weight on a dry weight basis. Sheets of homogenized tobacco material may be formed by agglomerating particulate tobacco obtained by grinding or otherwise comminuting one or both of tobacco leaf lamina and tobacco leaf stems; alternatively, or in addition, sheets of homogenized tobacco material may comprise one or more of tobacco dust, tobacco fines and other particulate tobacco by-products formed during, for example, the treating, handling and shipping of tobacco. Sheets of homogenized tobacco material may comprise one or more intrinsic binders, that is tobacco endogenous binders, one or more extrinsic binders, that is tobacco exogenous binders, or a combination thereof to help agglomerate the particulate tobacco. Sheets of homogenized tobacco material may comprise additives including, but not limited to, tobacco and non-tobacco fibers, aerosol-formers, humectants, plasticizers, flavourants, fillers, aqueous and non-aqueous solvents and combinations thereof.

As used herein, the term "sheet" denotes a laminar element having a width and length substantially greater than the thickness thereof.

As used herein, the term "crimped" denotes a sheet or web with a plurality of corrugations.

As used herein, the term "corrugations denotes a plurality of substantially parallel ridges "formed from alternating peaks and troughs joined by corrugation flanks. This includes, but is not limited to, corrugations having a square wave profile, sinusoidal wave profile, triangular profile, sawtooth profile, or any combination thereof.

As used herein, the term "crimp corrugations" refers to the corrugations on a crimped sheet or web.

As used herein, the term "substantially interleave" denotes that the corrugations of the first and second rollers at least partially mesh. This includes arrangements in which the corrugations of one or both of the rollers are symmetrical or asymmetrical. The corrugations of the rollers may be substantially aligned, or at least partially offset. The peak of one or more corrugations of the first or second rollers may interleave with the trough of a single corrugation of the other of the first and second rollers. Preferably, the corrugations of the first and second rollers interleave such that substantially all of the corrugation troughs of one of the first and second rollers each receive a single corrugation peak of the other of the first and second rollers.

As used herein, the term "longitudinal direction" refers to a direction extending along, or parallel to, the length of a sheet or web.

As used herein, the term "width" refers to a direction perpendicular to the length of a web or sheet, or in the case of a roller, parallel to the axis of the roller.

As used herein, the term "pitch value" refers to the lateral distance between the troughs at either side of the peak of a particular corrugation.

As used herein, the term "rod" denotes a generally cylindrical element of substantially circular or oval cross-section.

As used herein, the terms "axial" or "axially" refer to a direction extending along, or parallel to, the cylindrical axis of a rod.

As used herein, the terms "gathered" or "gathering" denote that a web or sheet is convoluted, or otherwise compressed or constricted substantially transversely to the cylindrical axis of the rod.

As used herein, the term "amplitude value" refers to the height of a corrugation from its peak to the deepest point of the deepest directly adjacent trough.

As used herein, the term "corrugation angle" refers to the angle between the corrugation flanks of a particular corrugation. One or more of the corrugations may be symmetrical about the radial direction. That is, the angle between each flank of a corrugation and the radial direction, or the "flank angle", may be the same and equal to half the corrugation angle. One or more of the corrugations may be asymmetrical about the radial direction. That is, the flank angles of both flanks of a corrugation may be different.

The "diameter" of a roller refers to the maximum diameter of the same. A roller may be considered as a cylinder having a plurality of ridges. The maximum diameter thus occurs when a cross section is taken along a plane perpendicular to a rotational axis of the roller and passing through the tip of a ridge. The minimum diameter is present in a cross section along a plane perpendicular to a rotational axis of the roller and passing through a bottom of a valley between two ridges. If the diameter is intended as something different than the maximum diameter, it will be specified in the following. Further, a "distance" between two crimping rollers is considered as the distance between their closest surface points, that is, a distance between the closest points one present in one roller and one present in the other roller.

A "unit of length" refers to any discrete, pre-established length or distance having a constant magnitude which is used as a reference or convention to express linear dimension. Therefore a number of ridges per unit length means that, taken a length having a constant magnitude, the number of ridges present within said length is measured. Generally this unit of length is measured along a direction parallel to the axis of rotation of the roller.

The apparatus and the method of the invention may be used to crimp a sheet of material. For example, such a sheet could be a sheet of homogenized tobacco material. In order to crimp the sheet, the apparatus includes a first and a second main roller to perform a crimping of the sheet as well as a pre-crimping roller, which, together with the first main roller, perform a pre-crimping of the sheet. Between the pre-crimping roller and the first main roller, the sheet of material is inserted in order to pre-crimp the sheet, that is, in order to form corrugations on the same according to a first pattern. Then, the pre-crimped sheet is inserted between the first and second main roller to crimp the same, that is, to form again corrugations on the sheet according to a second pattern.

The corrugations according to the first or second pattern are formed by the apparatus or according to the method of the invention by means of ridges formed in the main rollers or in the pre-crimping roller.

Ridges are realized on an external surface of the first and second main rollers, therefore forming a corresponding first and a second plurality of ridges, and on the external surface of the pre-crimping roller, forming a third plurality of ridges, and preferably extend circumferentially around the surface itself.

Preferably, the ridges of the first, second or third plurality are parallel one to the other.

The ridges of the first, second or third plurality may be formed in the whole external surface of the first main roller, second main roller or pre-crimping roller or only in a part thereof.

Each roller defines a rotation axis around which the roller (first main roller, second main roller or pre-crimping roller) is adapted to rotate. The first main roller, the second main roller or the pre-crimping roller may have a cylindrical shape. In this case, the rotation axis coincides with the axis of the cylinder.

The surfaces of the main rollers or pre-crimping roller may be made of hard material such as steel.

The ridges of the first, second or third plurality can be perpendicular to the rotation axis or can be even slightly inclined with respect to the same.

The ridges of the first, second or third plurality may have a constant pitch value.

Preferably, the ridges of the first, second or third plurality have a constant amplitude along their extension, and even more preferably this constant amplitude is the same for all ridges in a roller. However, the amplitude of the ridges of the first plurality may differ from the amplitude of the third plurality or the second plurality.

Preferably, the ridges of the first and second plurality interleave. Therefore, when the sheet of material is inserted between the first and the second main roller, the first and second plurality of ridges form corrugations onto the surfaces of the sheet. The corrugations have a given pattern which depends, among others, on the amplitude of the first and second plurality of ridges and on their pitches, as well as on the distance between the first and the second main roller.

Preferably, the ridges of the first and the third plurality interleave. Therefore, when the sheet of material is inserted between the pre-crimping roller and the first main roller, the first and third plurality of ridges form corrugations onto the surfaces of the sheet. The corrugations have a given pattern which depends, among others, on the amplitude of the first and third plurality of ridges and on their pitches, as well as on the distance between the pre-crimping roller and the first roller.

The corrugations formed on the sheet at the end of the whole crimping process are therefore given by the sum of the corrugations formed when the sheet has been deformed by the first and third plurality of ridges and when the sheet has been deformed by the first and second plurality of ridges.

Due to the fact that the pre-crimping of the sheet between the first main roller and the pre-crimping roller takes place before the crimping of the sheet between the first and the second main roller, the pattern formed by the first and second main roller on the surfaces of the sheet of material is formed on the pattern already formed by the pre-crimping roller and first main roller.

The desired final pattern therefore is the result of two different steps, which takes place at different times and not at the same time, in each of which the deformation imparted to the sheet to form the corrugations is "less" than the total deformation.

Preferably the corrugations formed by the first and second plurality of ridges are formed on the corrugations formed by the first and third plurality of ridges. In this way, the first and second plurality of ridges deepen or reinforce the already present corrugations.

The "double-step" crimping limits the stress to which the sheet is subject at each single step and therefore reduces the possible damages.

Having a smaller pre-crimping roller, that is, a pre-crimping roller which has a smaller diameter than the main rollers, allow having the pre-crimping roller put into motion by the first main roller, without the aid of a motor. The inertia of the main roller is enough to pull the smaller pre-crimping roller along with it. The diameter considered is the "outer or maximum diameter" of the roller. Thus the maximum diameter of the pre-crimping roller is smaller than the maximum diameter of the main roller.

Preferably, the diameter of the pre-crimping roller is smaller than about 100 millimeters. More preferably, the preferred diameter is comprised between about 20 millimeters and 60 millimeters, even more preferably between about 30 millimeters and 50 millimeters. Preferably, the diameter of the first main roller is above 100 millimeters, more preferably between about 150 millimeters and 300 millimeters, more preferably of about 200 millimeters.

Preferably, the pre-crimping roller is idle. That is, the pre-crimping roller is not driven by a pulley or a motor, but it is dragged onto motion by the motion of the main roller and the friction caused by the sheet in between the pre-crimping and main roller.

Advantageously, according to the inventive method or apparatus, the first plurality of ridges has a first given pattern, the second plurality of ridges has a second given pattern, and the third plurality of ridges has a third given pattern, the third pattern being different than the first pattern of the first plurality of ridges. The first, second and third plurality of ridges determine the corrugation patterns of the sheet of material. The corrugation pattern of the first and second rollers at least interleave substantially so that the corrugations of the first and second rollers at least partially mesh. Preferably, the third and first plurality of ridges at least interleave substantially, too. Preferably, the sheet of material when moving between the first and third rollers suffers less deformation then when being transported between the first and second rollers. Preferably, the pattern of the first and second plurality of ridges is the same, while the pattern of the third plurality of ridges is different from the pattern of the first and the second plurality of ridges. The differences can be as follows. The third plurality of ridges may have a different amplitude than the first or second plurality of ridges. Preferably, the amplitude of the third plurality is lower than the amplitude of the first or second plurality. The third plurality of ridges may have a different pitch than the first or second plurality of ridges. Preferably, the third plurality of ridges has a smaller pitch than the first and second plurality. The third plurality of ridges may have a different flank angle than the first or second plurality of ridges.

Advantageously according to the inventive method or apparatus the pre-crimping roller is located upstream the first and second main roller in the direction of transport of the sheet of material. The sheet of material can be pre-treated prior to the crimping process between the first and second rollers. In particular, the pre-crimping roller together with the first roller form already a corrugation pattern to the sheet of material.

Advantageously, according to the inventive method or apparatus, a distance between the first main roller and the pre-crimping roller is different from a distance between the first and the second main rollers. More preferably, the distance between the first and the pre-crimping roller is larger than the distance between the first and the second main roller. Favourably, the sheet of material is crimped less on the side facing the third roller than on the side facing the first roller. Favourably, the first and the pre-crimping rollers exert less pressure onto the sheet of material than the first and second main rollers, thus pre-crimping the sheet in a gentle manner. Advantageously, the ridge of the first plurality defines a first ridge amplitude and the ridge of the third plurality defines a third ridge amplitude, and the third amplitude is shorter than the first amplitude. Favourably, the sheet of material is less deformed during the pre-crimping than during the crimping, allowing for a gentle pre-treatment of the sheet.

Advantageously, a number of ridges per unit length in the first plurality is higher than the number of ridges per unit length in the third plurality. Favourably, the sheet of material is less deformed during the pre-crimping than during the crimping, allowing for a gentle pre-treatment of the sheet.

Advantageously, the set of crimping rollers includes a second pre-crimping roller facing the first main roller, the second pre-crimping roller positioned upstream the pre-crimping roller in the transport direction. Preferably, each of the pre-crimping rollers performs a pre-crimping action and therefore the deformation of the sheet is even more gentle.

Advantageously, the second pre-crimping roller is positioned upstream the pre-crimping roller in the transport direction. Preferably, the second pre-crimping roller includes a fourth plurality of ridges having a fourth pattern. The pre-crimping action onto the sheet can also be divided in a plurality of sub-steps, each sub-step being performed by one of the pre-crimping rollers together with the first main roller. In each sub-step a deformation of the sheet is performed. The total deformation, that is, the total crimping of the sheet, is given by the sum of all deformation caused during the sub-steps and the main crimping between the first and second main roller. Less damage to the sheet can be obtained.

Preferably, the fourth pattern is different from the third pattern of the third plurality of ridges. Preferably, each of the pre-crimping rollers may deform the sheet of material differently from the others.

Advantageously, a distance between the first main roller and the second pre-crimping roller is different than a distance between the first main roller and the pre-crimping roller. The pre-crimping process can be performed with increasing intensity towards the main rollers.

Advantageously, the ridge of the fourth plurality defines a fourth ridge amplitude and the fourth amplitude is different from the third amplitude. More preferably, the fourth ridge amplitude is shorter than the third ridge amplitude. The intensity of the pre-crimping process can be gently increased towards the main rollers.

Advantageously, the set of crimping rollers includes a plurality of pre-crimping rollers, each pre-crimping roller facing the first main roller, and the plurality of pre-crimping rollers is placed adjacent the first main roller within an angular interval centered at a rotational axis of the first main roller of less than about 180°. The arrangement is compact and space saving. The path of the sheet of material remains unchanged compared to conventional crimping where the sheet of material runs on the first roller before being transported between the first and second rollers and, subsequently runs on the second roller. By maintaining the transport path of the sheet of material, additional stress to the sheet can be avoided and the risk of damage to the sheet is reduced.

Advantageously, the set of crimping rollers includes a second pre-crimping roller, a diameter of the second pre-crimping roller being smaller than a diameter of the first and second main rollers. This allows a compact arrangement where the second pre-crimping roller can run on the first main roller parallel to one or more other pre-crimping rollers.

Advantageously, a diameter of the first main roller is substantially equal to a diameter of the second main roller. This allows for a conventional crimping process between the two main rollers.

Advantageously, the sheet of material is one of: a homogenized tobacco sheet, a plastic sheet or a sheet including cellulose.

Advantageously, the method includes the steps of gathering the crimped sheet of material, and forming a rod using the gathered crimped sheet of material are included. The crimping process is preferably used for the production of rods which are preferably used in the manufacturing of aerosol generating articles.

Advantageously, wrapping the rod is performed. Preferably, the rod is wrapped in wrapping paper.

Advantageously, the method includes the step of cutting the continuous rod into a plurality of rod-shaped components, each rod-shaped component having a gathered crimped sheet formed from a cut portion of the crimped sheet, the crimp corrugations of the crimped sheet defining a plurality of channels in the rod-shaped component.

The rod-shaped component is preferably a component of an aerosol generating article.

The invention will be further described, by way of example only, with reference to the accompanying drawings in which.

Figure 1:
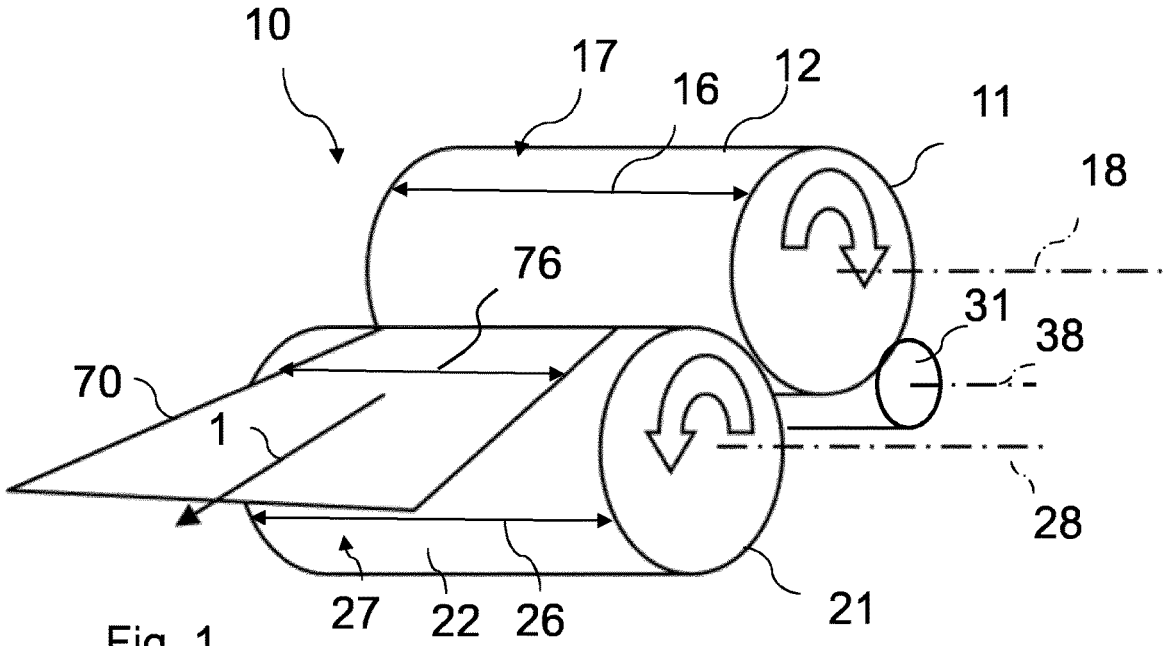
FIG. 1 shows an isometric view of an apparatus having two main rollers and a pre-crimping roller between which a sheet of material is treated according to the invention.

With initial reference to FIG. 1, the Figure shows an isometric view of an apparatus 10 comprising a first and second facing main crimping rollers 11, 21 between which a sheet 70 of material having the width 76 is treated according to the invention. The transport direction 1 of the sheet 70 is indicated with an arrow 1 in the FIG. 1.

The first and second facing crimping roller 11, 21 define a first and second rotation axis 18, 28, respectively. The surfaces of the rollers 11, 21 are provided with corrugations, where ridge- and trough pattern or corrugations 17, 27 are typically circumferential ridges on the surface of each roller 11, 21. The circumferential ridges may be perpendicular with respect to the rotation axes 18, 28 or may be slightly inclined.

The diameter of the first and second crimping roller is of about 208 millimeters.

The corrugations 17, 27 (not shown in detail in the figure) of the first and second rollers 11, 21 at least partially mesh. The corrugations 17, 27 of one or both of the rollers 11, 21 are symmetrical or asymmetrical. The peak of one or more corrugations of the first or second rollers 11, 21 may interleave with the trough of a single corrugation of the other of the first and second rollers 11, 21. Preferably, the corrugations 17, 27 of the first and second rollers 11, 21 interleave such that substantially all of the corrugation troughs of one of the first and second rollers 11, 21 each receive a single corrugation peak of the other of the first and second rollers 11, 21. The surface patterns of both rollers 11, 21 are transmitted to the surfaces of the sheet 70 when transported between the two rollers 11, 21.

The amplitude of the corrugations in the first and second roller is equal to about 0.67 millimeters.

The apparatus 10 also comprises a pre-crimping roller 31, which defines a rotation axis 38 parallel to the rotation axes 18, 28 of the main rollers 11, 21, and which at least partially meshes with the first main roller 11. The pre-crimping roller 31 rolls on the first main crimper 11 prior to crimping. No motor or pulley drives the pre-crimping roller, the motion of the main roller or the friction with the sheet put it into motion.

The pre-crimping roller 31 includes corrugations having an amplitude of 0.67 millimeters. Preferably, the distance between the pre-crimper and the first crimping roller is bigger than the distance between the first and second rollers, so the ridges of the pre-crimping roller do not go as deep in the sheet as those of the first and second roller when the sheet is in the crimping phase.

For example, the distance between the main first and second rollers is such that the corrugations formed in the sheet of material have a depth preferably comprised between about 0.36 millimeters and about 0.4 millimeters. For example, the distance between the main first and pre-crimping rollers is such that the corrugations formed in the sheet of material have a depth preferably comprised between about 0.25 millimeters and about 0.35 millimeters.

The sheet 70 runs on the first main roller 11 and is then transported between the pre-crimping roller 31 and the first main roller 11 and subsequently transported between the two main rollers 11, 21.

Accordingly, the sheet 70 moves between this pre-crimping roller 31 and the first main roller 11 to be pre-crimped prior to the main crimping process which takes place between the two main rollers 11, 21. Advantageously, the number of ridges of the pattern of the pre-crimping roller 31 may differ from the number of ridges of the pattern of the main crimping rollers 11, 21 and/or the depth of the troughs and/or the amplitude of ridges may be different. This results in a gently pre-crimping of the sheet 70 before the main crimping process is performed between the two main rollers 11, 21, thus allowing a higher processing speed without damaging the sheet 70.

Figure 2:
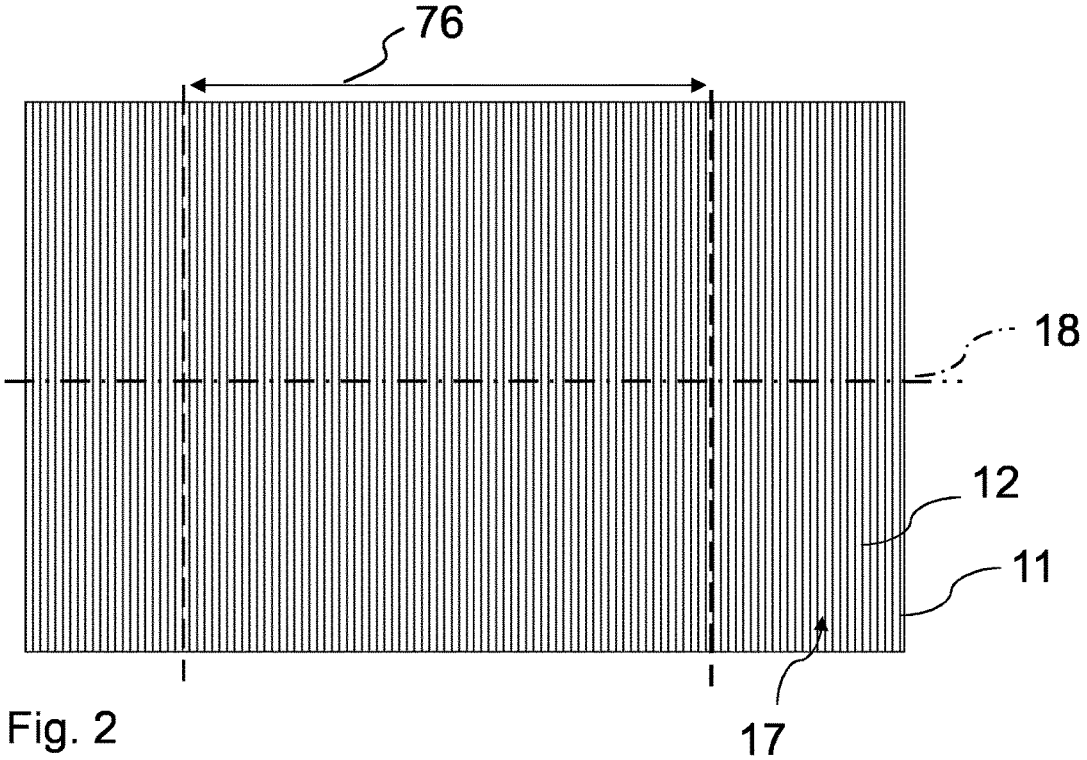
FIG. 2 shows a two-dimensional representation of a surface of a roller having a ridge-and-trough pattern.

As can be seen in FIG. 2, where the first roller 11 is depicted as a two dimensional area for clarity, the surface 12 of the roller 11 has a conventional ridge-and-trough pattern 17. The ridge-and-trough pattern 17 is comprised of circumferential ridges, each ridge defining a ridge amplitude. The ridges can be oriented perpendicular to the rotation axis 18 or can be slightly inclined, e.g. by not more than 10°.

The crimping is characterized among others by the number of lines of the corrugation pattern of the main crimping rollers 11, 21 and the depth of the troughs and the amplitude of the ridges of the corrugations 17, 27.

The second main roller 21 (FIG. 1) preferably has the same size and the same ridge- and trough pattern 27 (FIG. 1) as corrugations as the first main roller 11.

Figure 3:
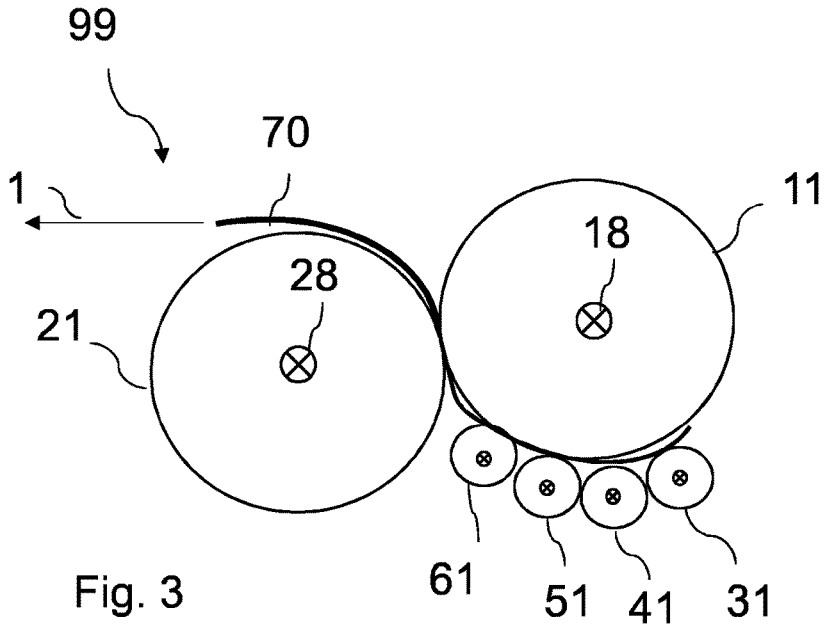
FIG. 3 shows in a side view an arrangement of two main rollers and a set of pre-crimping rollers between which a sheet of material is transported.

FIG. 3 shows in a side view a detail of a schematically depicted further embodiment of an apparatus 99 for crimping the sheet 70. Detail analog to apparatus 10 are indicated with the same reference number. The apparatus 99 comprises an arrangement of two main rollers 11, 21 and a set of pre-crimping rollers 31, 41, 51, 61 between which a sheet 70 of material is transported. The pre-crimping rollers 31, 41, 51, 61 are rolling on the first main roller 11 so that the sheet 70 of material is transported successively between the pre-crimping rollers 31, 41, 51, 61 and the first main roller 11.

Each pre-crimping roller 31, 41, 51, 61 has a specific crimping pattern determined according to the crimping pattern (corrugations 17) of the main roller 11 and according to the patterns of the other pre-crimping rollers 31, 41, 51, 61. As a result, the cumulative and successive action of the pre-crimping rollers 31, 41, 51, 61 on the sheet 70 create a progressive crimping action on the sheet 70, for gently preparing the sheet 70 for the crimping, decreasing the crimping damage.

Optionally, each pre-crimping roller 31, 41, 51, 61 has only a part of the total crimping corrugations 17, 27 of the crimp pattern of the main roller 11, e.g. each pre-crimping roller 31, 41, 51, 61 having a pitch value which is larger than the pitch value of the main roller. For instance, in case of four pre-crimping rollers 31, 41, 51, 61, each pre-crimping roller 31, 41, 51, 61 may have only one crimping ridge in a unit length where the main roller 11 has four crimping ridges, so that the sum-up pattern of the four pre-crimping rollers 31, 41, 51, 61 is similar to the crimp corrugation of the main crimper 11. The crimping deformation on the sheet 70 material during the pre-crimping phase is only of ¼th on each pre-crimping roller 31, 41, 51, 61.

Optionally, each pre-crimping roller 31, 41, 51, 61 may have only one crimping ridge in a unit length where the main roller 11 has five crimping ridges (or above), so that the sum-up pattern of the four pre-crimping rollers 31, 41, 51, 61 is inferior to the pattern of the main crimper 11. The pitch value can be the same for each pre-crimping roller 31, 41, 51, 61. Optionally, the pitch value can be different among the pre-crimping rollers 31, 41, 51, 61. For instance, the first pre-crimping roller 31 that encounters the incoming sheet 70 may have only one crimping ridge in a unit length where the main roller has four or more crimping ridges, the second pre-crimping roller 41 may have two crimping ridges in the unit length etc. up to the same number of crimping ridges in the unit length as the main roller 11.

Optionally, each pre-crimping roller 31, 41, 51, 61 may have the same number of crimping ridges as the main roller 11, but the depth of the crimping increases from one pre-crimping roller 31, 41, 51, 61 to the next. In such embodiments, the troughs in the sheet 70 of material are progressively extended up to a depth slightly inferior to the crimping depth caused by the main rollers 11, 21. For instance in case of four pre-crimping rollers 31, 41, 51, 61, the first pre-crimping roller 31 that encounters the incoming sheet 70 may have a smooth or slightly textured surface, the second pre-crimping roller 41 may have a ridge amplitude of only 25% of the ridge amplitude of the main roller 11, the third pre-crimping roller 51 of 50% and the fourth pre-crimping roller 61 of 75% of the ridge amplitude of the main roller 11.

Optionally, each pre-crimping roller 31, 41, 51, 61 may have the same number of ridges per unit length as the main roller 11 with the same ridge amplitude, but a distance between the pre-crimping rollers 31, 41, 51, 61 and the main roller 11 decreases progressively. For instance, the distance between the main roller and the pre-crimping rollers 31, 41, 51, 61 may be reduced from the first pre-crimping roller 31 up to the last one for which the distance is slightly higher than the final distance between the two main rollers 11, 31.

In a preferred embodiment, the diameter of the pre-crimping rollers 31, 41, 51, 61 is about ⅒th of the diameter of the main roller 11. For instance the diameter of the pre-crimping rollers 31, 41, 51, 61 may be selected between about 0.015 m and about 0.03 m (up to 0.05 m) when the main roller 11 has a diameter of 0.20 m. This allows to arrange the pre-crimping rollers 31, 41, 51, 61 in less than 180° of the main roller 11.

Optionally, the progressive crimping action of the pre-crimping rollers 31, 41, 51, 61 may be performed in the following ways:

In case the crimping corrugation is not only made of corrugations parallel to the direction of the sheet 70, the corrugation pattern of each pre-crimping roller 31, 41, 51, 61 and the corrugation pattern of the main roller 11 the respective pre-crimping roller 31, 41, 51, 61 is rolling on must be so that the corrugation pattern on the surface of the one main roller 11 is N times the corrugation pattern on the pre-crimping roller 31, 41, 51, 61 surface, N being the number of times the peripheral of the pre-crimping roller 31, 41, 51, 61 could be put into the peripheral surface of the main roller 11. N is also equal to the ratio of the diameter of the main roller 11 divided by the diameter of the pre-crimping roller 31, 41, 51, 61.

Figure 4:
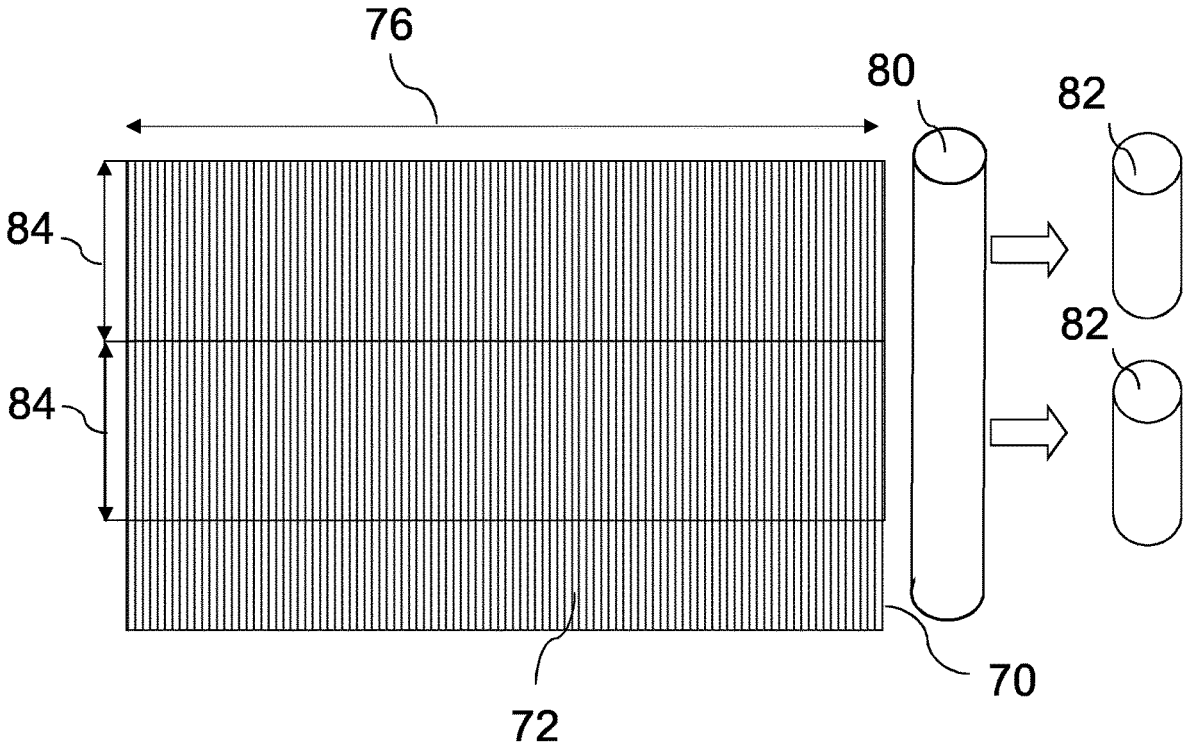
FIG. 4 shows a schematic top view of a treated sheet according to the invention where gathering and forming a rod and sticks is indicated.

FIG. 4 shows a schematic top view of a crimped sheet 70 according to the invention where gathering and forming a rod 80 and sticks 82 is indicated.

The surface of the sheet 70 shows corrugations which reproduce the corrugations on the surface of roller 11 in FIG. 2, for instance. The crimped sheet 70 of material is gathered and formed into a rod 80. The crimp corrugations of the crimped sheet 70 define a plurality of channels in the rod 80. The rod 80 is then wrapped and cut into sticks 82 having a stick length 84.

Figure 5:
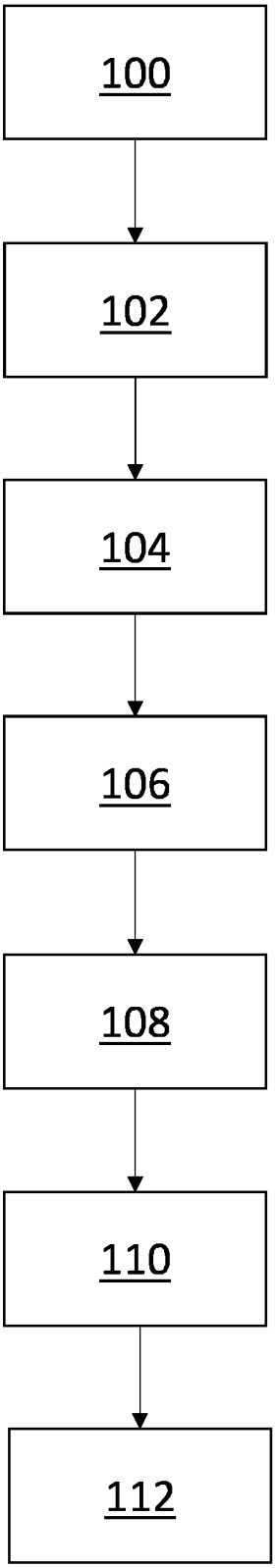
FIG. 5 shows a flow chart of a method for crimping a sheet of material according to the invention.

FIG. 5 shows a flow chart of a method for crimping a sheet of material according to the invention.

In a first step 100 a substantially continuous sheet of material is fed to a set of crimping rollers in a transport direction. The set of rollers comprise a first main roller, a second main roller and a pre-crimping roller. The first and second main rollers include a first and a second plurality of ridges across at least a portion of its width and the pre-crimping roller includes a third plurality of ridges across a portion of its width, a diameter of the pre-crimping roller being smaller than a diameter of the first and second main rollers.

In step 102, the substantially continuous sheet of material is pre-crimped between the first main roller and the pre-crimping roller to form the pre-crimped sheet by feeding the substantially continuous sheet between the first main roller and the at least one pre-crimping roller in the transport direction of the sheet such that the first plurality of ridges of the first main roller and the third plurality of ridges of the pre-crimping roller apply a first pattern of crimp corrugations to the substantially continuous sheet.

In step 104 the substantially continuous and pre-crimped sheet of material is crimped to form a crimped sheet by feeding the substantially continuous sheet between the first main roller and the second main roller such that the first and second plurality of ridges of the first and second main rollers apply a second pattern of crimp corrugations to the pre-crimped sheet.

In step 106, the crimped sheet of material is gathered, and a continuous rod is formed using the crimped sheet of material in step 108. In step 110, the continuous rod is wrapped, e.g. in cigarette paper.

In step 112, the continuous wrapped rod is cut into a plurality of rod-shaped components (sticks), each rod-shaped component having a gathered crimped sheet formed from a cut portion of the crimped sheet, the crimp corrugations of the crimped sheet defining a plurality of channels in the rod-shaped component.

The invention claimed is:

1. A method of manufacturing a crimped sheet of material for an aerosol-generating article, the method comprising the steps of:

feeding a substantially continuous sheet of material to a set of crimping rollers in a transport direction, the set of rollers comprising a first main roller, a second main roller and a pre-crimping roller, the first and second main rollers including a first and a second plurality of ridges, respectively, across at least a portion of their width and the pre-crimping roller including a third plurality of ridges across a portion of its width, the pre-crimping roller being of a smaller diameter than the first and second main rollers wherein the first plurality of ridges has a first given pattern, the second plurality of ridges has a second given pattern, and the third plurality of ridges has a third given pattern, the third pattern being different from the first pattern of the first plurality of ridges;

pre-crimping the substantially continuous sheet of material to form a pre-crimped sheet by feeding the substantially continuous sheet between the first main roller and the pre-crimping roller such that the first plurality of ridges of the first main roller and the third plurality of ridges of the pre-crimping roller apply a first pattern of crimp corrugations to the substantially continuous sheet; and crimping the pre-crimped sheet of material to form a crimped sheet by feeding the substantially continuous sheet between the first main roller and the second main roller such that the first and second plurality of ridges of the first and second main rollers apply a second pattern of crimp corrugations to the pre-crimped sheet.

2. The method according to claim 1, wherein the pre-crimping roller is idle.

3. The method according to claim 1, wherein the pre-crimping roller is located upstream the first and second main rollers in the direction of transport of the sheet of material.

4. The method according to claim 1, wherein the ridges of the first plurality defines a first ridge amplitude and the ridges of the third plurality defines a third ridge amplitude, and wherein the third amplitude is shorter than the first amplitude.

5. The method according to claim 1, wherein a number of ridges per unit length along a direction parallel to the axis of rotation of the roller in the first plurality is higher than the number of ridges per unit length along a direction parallel to the axis of rotation of the roller in the third plurality.

6. The method according to claim 1, wherein the set of crimping rollers includes a second pre-crimping roller facing the first main roller, the second pre-crimping roller being positioned upstream the pre-crimping roller in the transport direction.

7. The method apparatus according to claim 6, wherein the second pre-crimping roller includes a fourth plurality of ridges having a fourth pattern.

8. The method according to claim 1, wherein the set of crimping rollers includes a plurality of pre-crimping rollers, each pre-crimping roller facing the first main roller, and the plurality of pre-crimping rollers being placed adjacent the first main roller within an angular interval centered at a rotational axis of the first main roller of less than about 180°.

9. The method according to claim 1, wherein the set of crimping rollers includes a second pre-crimping roller, a diameter of the second pre-crimping roller being smaller than the diameter of the first and second main rollers.

10. The method according to claim 1, wherein the diameter of the first main roller is substantially equal to the diameter of the second main roller.

11. The method according to claim 1, wherein the sheet of material is one of: a homogenized tobacco sheet, a plastic sheet or a sheet including cellulose.

12. The method according to claim 1, including the steps of:

gathering the crimped sheet of material, and forming a rod using the gathered crimped sheet of material.

13. The method according to claim 12, including:

wrapping the rod.

14. The method according to claim 13, comprising the step of:

cutting the continuous rod into a plurality of rod-shaped components, each rod-shaped component having a gathered crimped sheet formed from a cut portion of the crimped sheet, the crimp corrugations of the crimped sheet defining a plurality of channels in the rod-shaped component.

* * * * *